US005397156A

United States Patent [19]

Schach et al.

[11] Patent Number: 5,397,156

[45] Date of Patent: Mar. 14, 1995

[54] PERSONALIZED BOOK KIT

[76] Inventors: Thomas M. Schach, 10303 Shiloh St., Fairfax, Va. 22030; Lynn M. Knowles, 6113 29th St., N., Arlington, Va. 22207

[21] Appl. No.: 111,865

[22] Filed: Aug. 26, 1993

[51] Int. Cl.[6] ..... B42D 15/00

[52] U.S. Cl. ..... 283/67; 281/51; 283/117; 206/424

[58] Field of Search ..... 206/206, 232, 424, 459.5, 206/497; 281/15.1, 51; 283/63.1, 67, 117

[56] References Cited

U.S. PATENT DOCUMENTS

| | | | |
|---|---|---|---|
| 2,621,785 | 12/1952 | De Pace | 206/424 |
| 2,728,450 | 12/1955 | Haire | 206/424 |
| 3,303,603 | 2/1967 | Abeson | 206/424 |
| 5,114,291 | 5/1992 | Hefty | 283/67 |
| 5,141,252 | 8/1992 | Michlin | 281/15.1 |
| 5,213,461 | 5/1993 | Kalisher . | |

OTHER PUBLICATIONS

Swan Publishing "Personalized Romance Novels TM" Questionnaire, 1990.

Amore Pagewriter Publishing Questionnaire, 1992.

*Primary Examiner*—Richard K. Seidel
*Assistant Examiner*—Hwei-Siu Payer
*Attorney, Agent, or Firm*—Nixon & Vanderhye

[57] ABSTRACT

A kit enhances the marketability of personalized books, such as paperback romance novels. The kit includes a simulated book constructed of a book cover and foam core adhesively secured to it, and a questionnaire for insertion of personalized information. The questionnaire and a reply addressed envelope are provided between the cover and the foam core, and the simulated book is shrink wrapped in transparent plastic. The questionnaire is on difficult to accurately photocopy paper, such as colored paper and/or ink with a distinctive watermark or printed background design, and/or a serial number (e.g. in bar code format). Instructions on what to do with the questionnaire are provided on the rear face of the simulated book cover. The kit is sold for a price that includes printing and delivery of the basic personalized book, and when a completed original questionnaire is received the personalized book is printed utilizing as part of the text of the book the personalized information on the questionnaire, and is delivered to the purchaser.

20 Claims, 3 Drawing Sheets

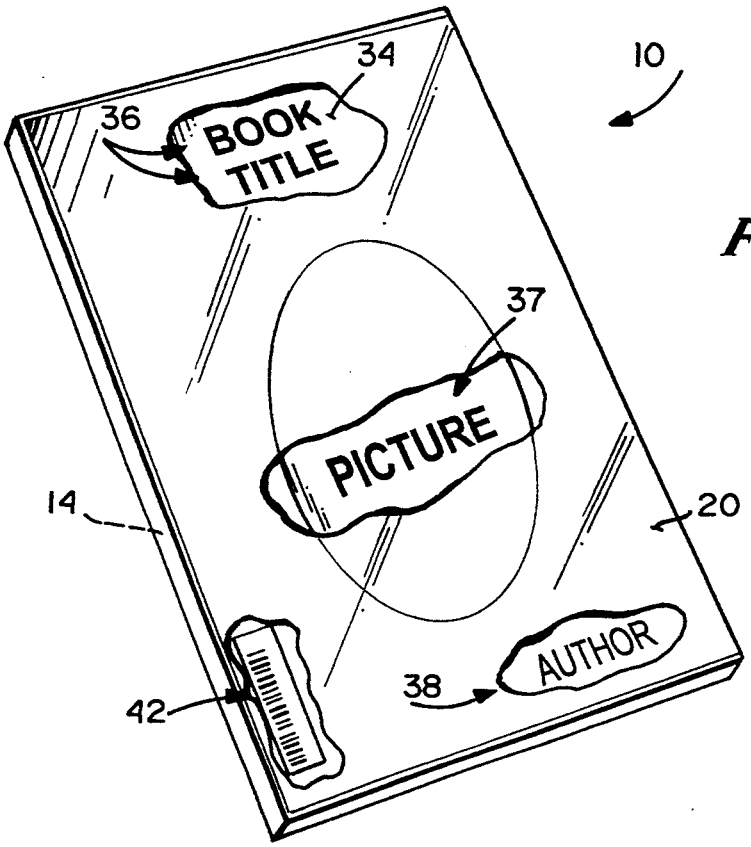
*Fig. 1*
*Fig. 2*
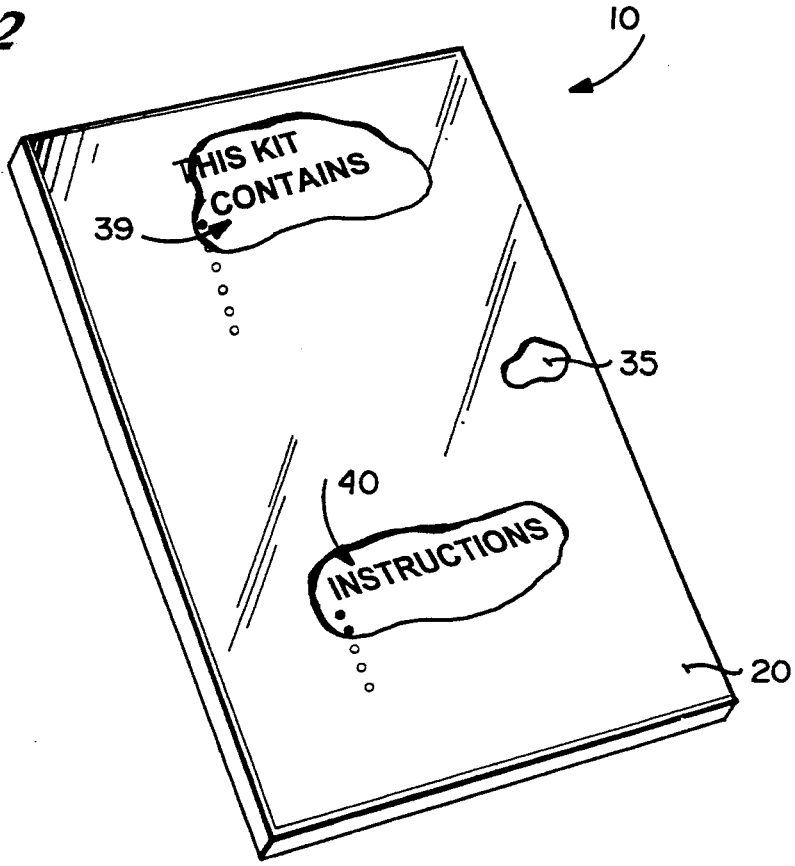

Fig. 3
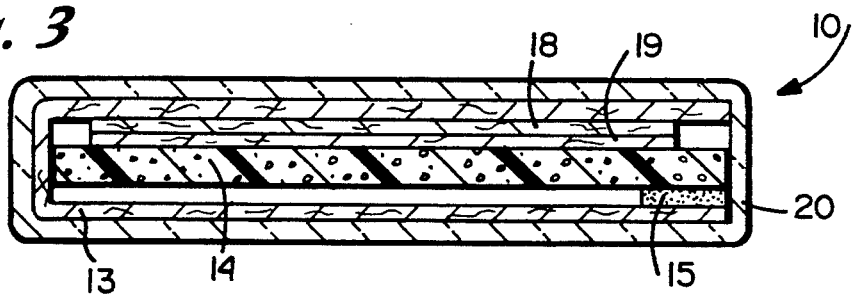
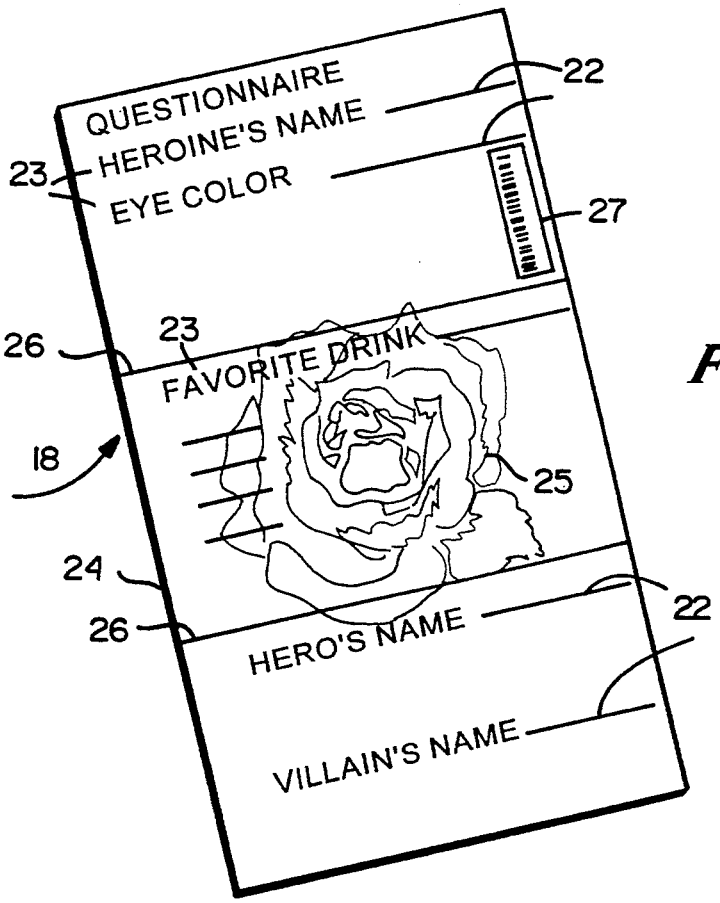
Fig. 4
Fig. 5
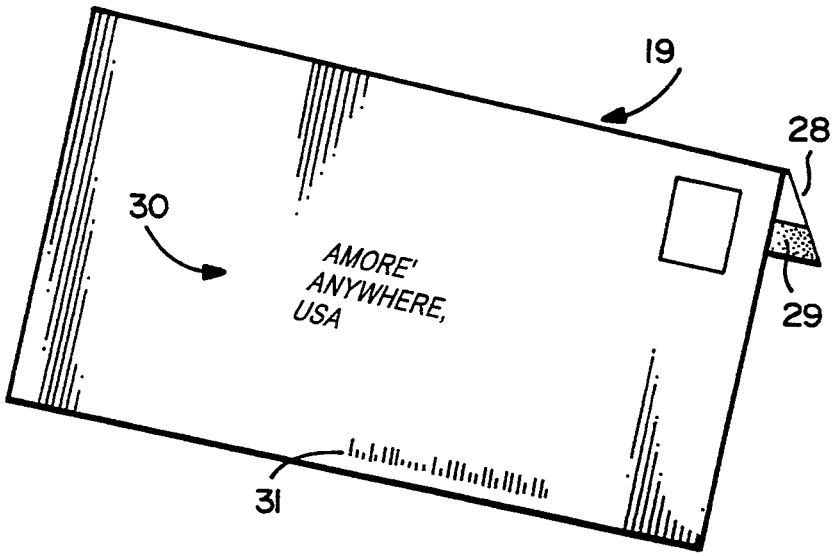

PERSONALIZED BOOK KIT

BACKGROUND AND SUMMARY OF THE INVENTION

An intriguing novelty service that has been provided for several years relates to the production of personalized books, such as romance novels. In the performance of the prior art service, a potential customer calls or writes the company offering the service to request a questionnaire and information, and returns payment with the completed questionnaire. Then the personalized romance novel is published utilizing the information on the questionnaire, and sent to the customer. This service is not particularly effective, however, because it requires the customer to plan substantially in advance, and to take the initiative to obtain the questionnaire and related information, and is not subject to retail marketing, or point-of-purchase impulse decisions.

According to the present invention, a kit for a personalized book, and a method of producing and distributing a personalized book, are provided which avoid the problems associated with the prior art services. According to the present invention, a tangible product is produced which can be purchased and sold itself. The tangible product gives the purchaser a realistic indication of the final product, as well as appropriate instructions, and allows the customer to give the kit as a gift itself. Because a tangible product is involved, personalized books can be marketed through retail outlets and mail order catalogs, and the organizations offering the kits for sale are paid at the time of the sale of the kits (up front), rather than when the questionnaires are sent in. This makes the entire process more efficient, facilitates impulse buying, and makes what was formerly merely a service widely marketable through retail outlets and mail order catalogs.

According to one aspect of the present invention a kit is provided comprising the following elements: A simulated book. A questionnaire having a plurality of blank spaces for insertion of personalized information for a personalized book corresponding to the simulated book. And, packaging means for packaging the simulated book and questionnaire so that at least a portion of the simulated book is visible from the exterior of the packaging means.

The kit also typically includes a reply envelope with a reply address on it, disposed within the packaging, which packaging typically is transparent shrink wrap plastic. The simulated book preferably has substantially the same size and shape as a real paperback novel; i.e. roughly about 4 inches$\times$7 inches, and about $\frac{1}{8}$–$\frac{3}{4}$ inch thick. The simulated book preferably includes a book cover and a piece of foam core covered by the book cover, and attached to the book cover by a single strip of adhesive or a coating of spray adhesive. The questionnaire and reply envelope are provided between the cover and the foam core, and instructions can be printed on the back face of the cover, readily readable through the shrink wrap plastic. The kit thus has a size that is substantially the same as the final product book that will be delivered when the questionnaire is completed and returned to the company selling the kits.

In order to prevent fraud—since the purchasers of the kit merely complete and send in the questionnaire, not providing any money with the questionnaire—the questionnaire is preferably printed on difficult to accurately photocopy paper, e.g. colored paper, with difficult to photocopy ink, and/or with a serial number (e.g. in bar code format). For example the questionnaire can be on paper having a color other than white, and having a visible distinctive water mark or printed background design, or have any of a wide variety of well known security features used to prevent reproduction of checks, title documents, and the like (such as those which display the word "Void" when photocopied). For example the questionnaire can be on pink paper having a rose watermark or printed background design, if the personalized book is a romance novel, and the ink could be reddish-purple.

According to another aspect of the present invention, a kit is provided comprising: A paper book cover having a front face with a title and pictorial representation, and a rear face. A piece of foam core covered by the book cover so as to provide a simulated book. A questionnaire disposed between the book cover and the foam core. And, transparent plastic packaging surrounding the simulated book so that the front and rear faces of the simulated book are visible therethrough.

According to another aspect of the present invention a method of producing and distributing a personalized book is provided. The method comprises the following steps: (a) Packaging a simulated book, that has an outward appearance and size substantially the same as the personalized book to be produced, with a questionnaire and instructions, in an integral package in which at least a part of the simulated book is readily visible. (b) Selling the integral package for a price that includes printing and delivery of the basic personalized book. (c) Receiving a completed questionnaire, with personalized information thereon. (d) Printing the personalized book using the personalized information from the completed questionnaire as part of the text of the book. And, (e) delivering the completed personalized book in accordance with the personalized information on the completed questionnaire.

Step (a) is typically practiced to provide the questionnaire on difficult to accurately photocopy paper, and step (d) is practiced only if the questionnaire received in step (c) is an original questionnaire on the difficult to accurately photocopy paper. Step (a) is also typically practiced by providing as the simulated book a piece of foam core covered by a book cover having substantially the same front face as the personalized book, with the questionnaire packaged between the cover and the foam core. Step (a) is also typically practiced to provide at least some of the instructions on the rear face of the book, and by providing a bar code with a serial number.

It is the primary object of the present invention to provide an effective kit, and method of producing and distributing a personalized book utilizing the kit, to make the sale and marketing of personalized books more effective. This and other objects of the invention will become clear from an inspection of the detailed description of the invention, and from the appended claims.

BRIEF DESCRIPTION OF THE DRAWINGS

FIG. 1 is a front top perspective view of an exemplary kit according to the present invention;

FIG. 2 is a rear top perspective view of the kit of FIG. 1;

FIG. 3 is an enlarged cross-sectional view of the kit of FIGS. 1 and 2, with the relative size of some of the components distorted for clarity of illustration;

FIG. 4 is a schematic top perspective view of the questionnaire in the kit of FIGS. 1 through 3, shown unfolded;

FIG. 5 is a top perspective view of the reply envelope from the kit of FIGS. 1 through 3.

DETAILED DESCRIPTION OF THE DRAWINGS

Figure 6:
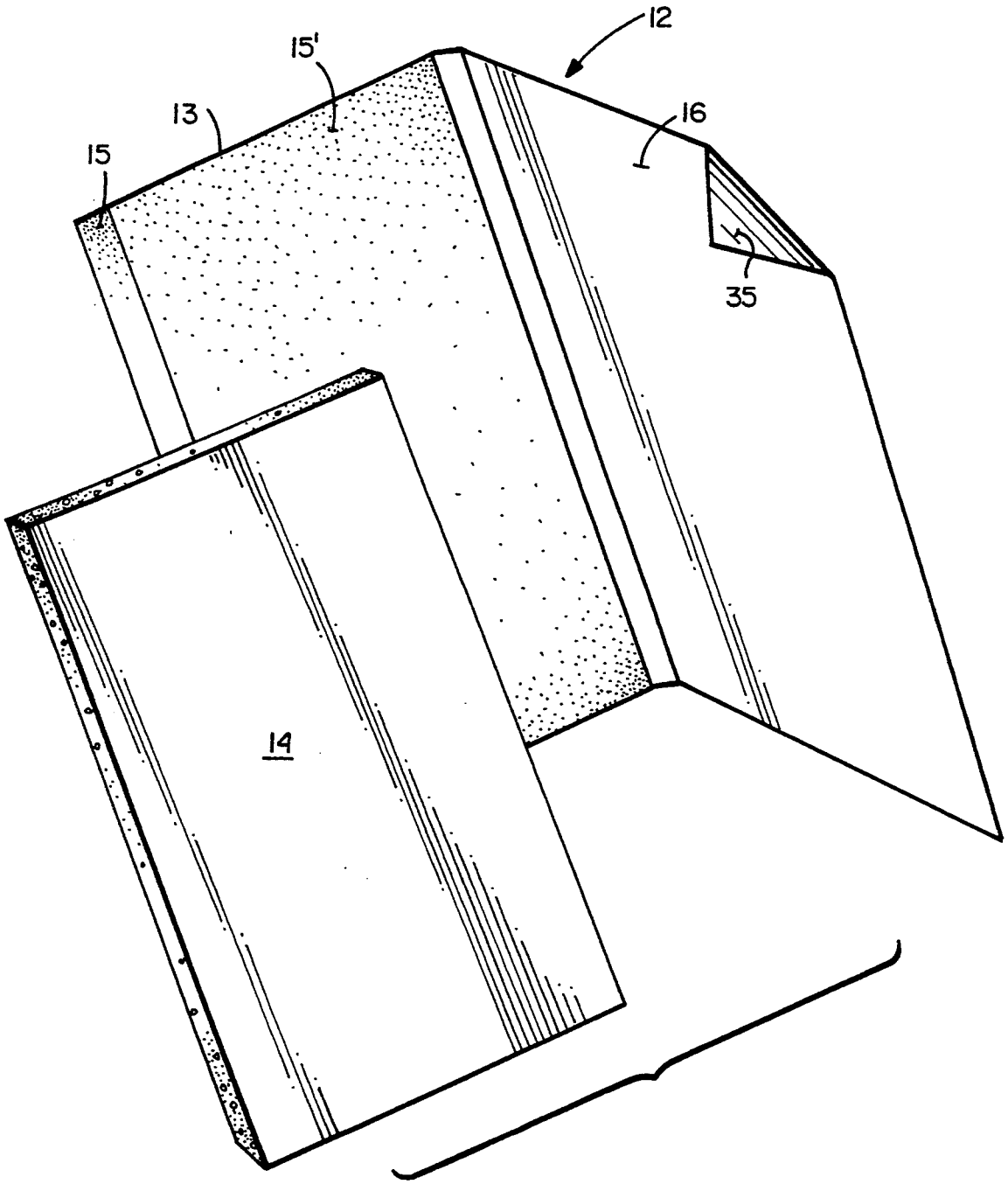
FIG. 6 is a schematic exploded top perspective view of the book cover and foam core from the kit of FIGS. 1 through 3.

An exemplary kit according to the present invention is shown generally by reference numeral 10 in FIGS. 1 through 3. The kit includes a simulated book, shown generally by reference numeral 12 in FIG. 6, which typically comprises a book cover 13, and one or more pieces (thicknesses) of foam core 14, or like material (preferably white in color and simulating what the pages of a book look like from the exterior, e.g. styrofoam laminated to paper board) which is adapted to be received within the cover 13. If desired the cover 13 and foam core 14 can be secured together, as by a strip of adhesive 15 extending along one edge of the inside surface 16 of the book cover 13, which engages a similar edge of one face of the foam core 14, or by spray adhesive 15' covering the entire inner face of the cover, or double index tape. The simulated book preferably has substantially the same size and shape as a real paperback novel, i.e. roughly about 4×7 inches, and about $\frac{1}{8}$–$\frac{3}{4}$ inch thick.

The kit 10 also comprises a questionnaire, shown generally by reference numeral 18 in FIGS. 3 and 4, preferably a reply envelope, shown generally by reference numeral 19 in FIGS. 3 and 5, and packaging means, shown in the form of transparent shrink plastic wrap 20 in FIGS. 1 through 3. The packaging means (transparent shrink wrap plastic) 20 comprises means for packaging the simulated book 12 and questionnaire 18 so that at least a portion of the book 12 is visible from the exterior of the packaging means 20.

The questionnaire 18 has a plurality of blank spaces, e.g. 22 (see FIG. 4) following questions 23, the information which is inputted on the blank spaces 22 being personalized information for the sellers of the kit 10 to personalize a book corresponding to the simulated book 12. For example the personalized book may be a romance novel, which is already known per se. The questionnaire 18 also may be a conventional questionnaire for personalized romance novels such as are known per se, except that it is preferably printed oil difficult to accurately photocopy paper, illustrated by reference numeral 24 in FIG. 4. By "difficult to accurately photocopy paper" is meant a serial number, paper color or design, ink color or design, or the like which makes it difficult to pass off a copy of a questionnaire as an original.

For example, the paper 24 is preferably of an unusual color, not standard white, and preferably also has a distinctive watermark or printed background design, such as the rose illustrated schematically at 25 in FIG. 4. For example for a questionnaire 18 for a romance novel, the paper 24 may be light pink, with a rose 25 as a watermark or printed background design having a color only slightly darker or lighter than the color of the paper 24. Under such circumstances, when one attempts to photocopy the questionnaire 18, it is readily discernible as a copy. Further, the ink printing the questionnaire may be difficult to copy, e.g. Pantone ® 220 (reddish-purple ink).

Alternatively, or in addition, the paper 24 may be of a security type paper having a number of dots of a size which readily reproduce with a photocopier, and a number of other dots of a size that do not, which spell out "Void" or a like warning word if photocopied, and/or a serial number can be provided (e.g. in the form of bar code label 27 in FIG. 4). The purpose of providing one or more of these features making the questionnaire difficult to accurately photocopy is to ensure that a legitimate questionnaire is sent back to the seller of the kits 10 since the purchaser will have paid for the basic personalized book at the time of purchase of the kit 10.

Note that the paper 24 preferably is folded about fold lines 26 so that it has a size slightly smaller than the size of the foam core 14 when it is provided in the kit 10, and it is provided between the cover 13 and the foam core 14, as illustrated in FIG. 3 and as inherently seen from FIGS. 1 and 2.

The reply envelope 19 is a standard reply envelope, having a flap 28 with adhesive 29 thereon, which is preprinted with the reply address 30, which may also be in bar code form as illustrated at 31 in FIG. 5. The reply envelope 19 is also disposed between the cover 13 and the foam core 14, as illustrated in FIG. 3, and as inherent in FIGS. 1 and 2. The reply envelope 19 preferably has a size slightly smaller than the length and width dimensions of the foam core 14, and slightly larger than the questionnaire 18 when folded about the fold lines 26 so that the questionnaire 18 may be easily inserted therein once the blanks 22 thereof have been filled out.

The kit 10 may also include other sheets of paper, such as a separate sheet of detailed printed instructions, sales literature for other or related products, guarantees, or the like. For example, one particularly worthwhile insert would be a folded sheet of paper with detachable order form (to fit in reply envelope 19) which describes and allows one to order options which enhance the "basic" book. For example, for additional sums (submitted with the reply envelope and questionnaire, e.g. by check or credit card charge authorization) one could order a personal message in the book, a custom page, or by submitting one's own photo have a custom cover or photo page made (with the submitted photo on it), including a custom cover with an "oil painting" version of the submitted photo (produced by computer photo-enhancement technology).

The simulated book 12 cover 13 has a front face 34 visible in FIG. 1, and a rear face 35, visible in FIG. 2 and a portion thereof visible at a bent over corner in FIG. 6. Preferably the front cover 34 is essentially identical to the front cover of the personalized book (e.g. paperback romance novel) that one obtains after purchase of the kit 10 and sending in the questionnaire 18, including a title 36, a picture indicated by indicia 37 (e.g. a seductive romantic picture), a real or fanciful author's name 38, etc.

The rear face 35 of the cover 13, on the other hand, preferably lists the contents of the kit 10, and provides at least some of the instructions for its use (that is such as "Fill Out the Enclosed Questionnaire and Return it in the Enclosed Reply Envelope to Amore, Anywhere, USA"), as indicated schematically by the indicia 39 and 40 in FIG. 2.

Finally, in order to facilitate inventory control and preclude counterfeiting, preferably there is a serial number, preferably bar code, and machine readable from the exterior of the kit 10, on the cover surface 34 or 35. For example bar code label 42 illustrated in FIG. 1 is shown adhesively secured directly to the front or the back of the cover 13, and it has the same serial number thereon as the bar code label 27 (FIG. 4).

Utilizing the kit 10 an advantageous and improved method of producing and distributing personalized books, such as paperback romance novels, may readily be practiced. The kit 10, which includes the simulated book 12 which preferably has an outward appearance and size substantially the same as the personalized book to be produced, along with the questionnaire 18 and instructions (e.g. 40) is sold for a price that includes printing and delivery of the basic personalized book. The kit 10 can be purchased in a retail establishment, by mail order catalog, or the like.

Once a customer purchases the kit 10 the customer removes the shrink wrap plastic 20, unfolds the questionnaire 18, fills in the blank spaces 22 of the questionnaire 18, folds it back up and inserts it into the reply envelope 19, adds any order for enhancements to the basic book (e.g. custom cover) with payment therefor, then mails the reply envelope 19 to the reply address 30. The sellers of the kit 10, upon receipt of the completed questionnaire 18, check it for authenticity (that is ensure that it is not a photocopy, but has the distinctive color of the paper 24 and ink of the legitimate questionnaires 18, and the distinctive watermark or printed background design 25 and a valid serial numer (27)), and then prints the personalized book using the personalized information filled in at the blanks 22 of the questionnaire 18. The completed personalized book is then delivered (typically to the customer filling out the questionnaire 18) in accordance with the personalized information on the completed questionnaire 18 (e.g. on a portion thereof requesting where to send the completed personalized book).

It will thus be seen that according to the present invention an advantageous kit facilitating the production of a personalized book, and a method of producing and distributing such a personalized book, have been provided. While the invention has been herein shown and described in what is presently conceived to be the most practical embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A method of producing and distributing a personalized book, comprising the steps of:

(a) packaging a simulated book, that has an outward appearance and size substantially the same as the personalized book to be produced, with a questionnaire and instructions, in an integral package in which at least a part of the simulated book is readily visible;

(b) distributing the integral package;

(c) receiving a completed questionnaire, with personalized information thereon;

(d) printing the personalized book using the personalized information from the completed questionnaire as part of the text of the book; and (e) delivering the completed personalized book in accordance with the personalized information on the completed questionnaire.

2. A method as recited in claim 1 wherein step (a) is practiced to provide the questionnaire on difficult to accurately photocopy paper; and wherein step (d) is practiced only if the questionnaire received in step (c) is an original questionnaire, on the difficult to accurately photocopy paper.

3. A method as recited in claim 1 wherein step (a) is further practiced by providing the simulated book with at least one piece of foam core covered by a book cover having substantially the same front face as the personalized book, and wherein the questionnaire is packaged between the cover and the foam core.

4. A method as recited in claim 3 wherein step (a) is further practiced by providing a pre-addressed reply envelope as part of the package, between the cover and foam core.

5. A method as recited in claim 3 wherein step (a) is further practiced by covering the simulated book and questionnaire with transparent shrink-wrap plastic.

6. A method as recited in claim 3 wherein step (a) is practiced by providing a bar code serial number readable by machine without opening the integral package, and by providing the same serial number in bar code form on the questionnaire.

7. A kit comprising:

a simulated book having substantially the same size and shape as a real paperback novel and including a simulated book cover;

a questionnaire having a plurality of blank spaces for insertion of personalized information for a personalized book corresponding to said simulated book; and packaging means for packaging said simulated book and questionnaire so that at least a portion of said simulated book cover is visible from the exterior of said packaging means.

8. A kit as recited in claim 1 further comprising a reply envelope with a reply address thereon, disposed within said packaging means.

9. A kit as recited in claim 8 wherein said packaging means is transparent shrink wrap plastic.

10. A kit as recited in claim 9 wherein said simulated book comprises at least one piece of foam core covered by said book cover.

11. A kit as recited in claim 1 wherein said questionnaire is on difficult to accurately photocopy paper of a color other than white, and has a visible distinctive background design, difficult to reproduce ink, and a serial number.

12. A kit as recited in claim 11 wherein said serial number is in the form of a bar code.

13. A kit as recited in claim 1 wherein said simulated book comprises at least one piece of foam core covered by said book cover.

14. A kit as recited in claim 9 further comprising an adhesive adhering a portion of said foam core to a portion of said book cover.

15. A kit comprising:

a paper book cover having a front face with a title and pictorial representation, and a rear face;

at least one piece of foam core covered by said book cover so as to provide a simulated book;

a questionnaire disposed between said book cover and said foam core; and transparent plastic packaging surrounding said simulated book so that said front and rear faces are visible therethrough.

16. A kit as recited in claim 15 wherein said questionnaire is on difficult to accurately photocopy paper, and wherein said book cover includes an inside, adhesive means adhering a portion of said inside of said book cover to a portion of said foam core.

17. A kit as recited in claim 15 wherein said simulated book has substantially the same size and shape as a real paperback novel.

18. A kit as recited in claim 15 further comprising a bar code serial number positioned so as to be machine readable from the exterior of said transparent plastic packaging, and the same serial number in the bar code form on the questionnaire.

19. A kit comprising:

a representation of a book cover;

a questionnaire being printed on paper that is difficult to reproduce by photocopying having a plurality of blank spaces for insertion of personalized information for a personalized book corresponding to the representation of a book cover, said paper of said questionnaire being of a color other than white and having a visible distinctive background design and a serial number; and packaging means for packaging said representation of the book cover and questionnaire so that at least a portion of said representation of the book cover is visible from the exterior of said packaging means.

20. A kit as recited in claim 19 wherein said serial number is in the form of a bar code.

* * * * *